United States Patent [19]

Pfaffinger

[11] 4,011,803

[45] Mar. 15, 1977

[54] RANGE-HOOD INSTALLATION DEVICE

[75] Inventor: Leonard G. Pfaffinger, Morango, Ill.

[73] Assignee: Aubrey Manufacturing, Incorporated, Union, Ill.

[22] Filed: Apr. 10, 1975

[21] Appl. No.: 566,974

[52] U.S. Cl. ..... 98/115 K; 29/453; 126/299 R

[51] Int. Cl.[2] ..... F23J 11/00

[58] Field of Search ..... 98/115 R, 115 K, 115 LH; 126/299 R, 299 A; 29/453

[56] References Cited

UNITED STATES PATENTS

| | | | |
|---|---|---|---|
| 2,839,987 | 6/1958 | Pryne | 98/115 K |
| 3,092,175 | 6/1963 | Suessle | 29/453 X |
| 3,362,319 | 1/1968 | Wallace | 98/115 K |
| 3,372,632 | 3/1968 | Stalker | 98/115 K |

*Primary Examiner*—Edward G. Favors
*Attorney, Agent, or Firm*—Alter and Weiss

[57] ABSTRACT

A range-hood installation device for use on canopy-type range-hoods so as to facilitate one-man installation by allowing preliminary juxtaposition of a range-hood against a wall or soffit through the use of two snap-in retaining brackets which hold the range-hood in place while allowing an installer to more easily finish complete installation by securing additional bolting devices.

6 Claims, 12 Drawing Figures

RANGE-HOOD INSTALLATION DEVICE

BACKGROUND OF THE INVENTION

The present invention relates generally to household appliance installation devices and more particularly to a range-hood installation retention device which secures a range-hood in place while final installation is performed so as to facilitate installation for the owner.

Over the last several years, the use of range-hoods of the canopy type has increased in both houses and apartments to the extent that the range-hood is no longer seen as a frivolous luxury but rather as a necessary kitchen accessory.

With the expanded usage of the range-hood as a necessary kitchen appliance for the exhausting of smoke and vapor filled, air, or in the case of ductless range-hoods through which the air is refiltered and exhausted back into the cooking area, means have been sought for an installation device which would facilitate the attachment of such a range-hood against a wall or soffit which would not only be relatively easy to mount but would also retain the hood against the wall or soffit in a necessary position while the installer attaches the final installation mounting devices. In this type of situation the installer would not have to physically hold the range-hood in position or have others position and hold it for him while he inserts the necessary fastening devices, as the range-hood would be held for him by the preliminary retaining devices.

While many attachment devices have been developed over the past century to accommodate the installation and attachment of hanging fixtures, such as the range-hood, wall shelving or electrical lighting devices, few, if any, have addressed themselves to the preliminary securing and attachment of such fixtures so as to simplify matters for the installer attempting to obtain final completion by holding the fixture in place for him while he accomplishes final installation.

Examples of some of these fastening devices start with the most basic, through which securement is achieved by the use of screwing or bolting devices such as self-tapping masonary screws with over-sized or standard sized flat heads. Surely installation of a range-hood can be accomplished where the installer is using such types of fastening devices. However, for the installer to attach a range-hood or other type of fixture in this way he must himself, or with the assistance of another person, position the fixture, or as in this case a range-hood, in the proper place and maintain it in that place against a wall or onto the bottom of a soffit, while he attempts the delicate and often cumbersome task of mounting the screw-type fasteners through the mounting holes of the range-hood and into the wall or soffit itself. As one could see or know from experience, it is often quite difficult to hold a large and often weighty range-hood in place with one hand while setting and starting the necessary screw-type fastening devices with another hand and a screwdriver.

Besides the most basic types of contemporary fastening devices which offer the greatest degree of difficulty towards installation of the range-hood or household fixture, there are several other devices which though more easy to install, still offer a significant degree of difficulty in mounting since the installer must still retain the range-hood itself in position against a wall or soffit to use these devices. One example of this type of fastening device is what is more commonly referred to as the toggle bolt. The toggle bolt itself consists of a non-tapered machine screw which fits into a threaded appendage. The appendage that the machine screw fits into is held between two spring-loaded flanged members which meet at an angle. The construction of the toggle device allows installation of the device through an already drilled hole in a wall or soffit. The two angular facing flanged members constrict so as to fit through this pre-drilled hole and once through the hole, expand like an opening umbrella due to the spring tension force loaded upon them. Slightly pulling back on the toggle bolt usually entrenches the elements against the inside of the wall or soffit through which the toggle device has been inserted. At this time, the machine screw which extends from the inside of the wall or soffit, attached to the appendage on the umbrella-type restraining device, can be screwed in so as to restrain virtually any type of fixture between its head and the wall. But even with this type of device with which the hole can be drilled before actual installation and mounted to a wall or soffit, the installer must still maintain the range-hood in physical position while the toggle bolt is being inserted and must similarly keep it in this position by exerted force, while the machine screw portion of the toggle bolt is slowly and carefully turned towards final exertion of pressure from the head of the machine-screw against the sheet metal being installed, acting so as to sandwich the sheet metal of the installed fixture between the machine-screw head and the wall or soffit surface.

For the most part, similar devices to the toggle bolt require the same type of installation effort to keep the range-hood in place while the fastening screw is being positioned and turned. Some examples of equally difficult to work with, yet similar fastening devices for mounting fixtures onto a wall or soffit, exist with what is commonly called restraining anchors and expansion bolts. While such devices take on several shapes and forms they have in common, the insertion behind the wall or soffit, and by either hammering into an inserted anchor as in the case of masonary, or by inserting the bolt into the threaded portion of an expansion device and by continually rotating the bolt so as to contort the shape of the expanding sides resting behind the wall or soffit, eventual seating of such devices takes place.

Other numerous modes of installation are available to an installer, especially if he has substantial access to the woodwork behind a wall or soffit. This would allow an installer to utilize hanger bars which extend from one joist to another joist securely attaching each behind the surface of the wall or the surface of the soffit. Fastening devices along the length of the hanger bar protrude outwardly from the behind the wall towards and past the surface of the wall or soffit thus exposing themselves so as to allow fastening through the use of a wing nut or standard nut over the protruding threaded bolt extending from the wall or soffit. In order to effectively use such a mounting device a great deal of effort must be exerted simply to install the hanger bar itself but even more importantly, the range-hood must still be held in place by force and in position while the final bolting procedure is accomplished by attaching and turning the nut onto the protruding threaded rod, after the range-hood assembly itself had been slipped over and along the threaded rod.

Several other adequate means for general fastening exist, such as recessed installation boxes, dry wall framing devices, reverse positioned bolts with protruding portions extending out from the wall or soffit, as well as for that matter the actual affixing of the fixture by nail or bolt to a locatable stud or joist behind the wall or soffit surface onto which the range-hood is being installed. But while all these devices have been proven over the years as being successful attaching devices, few, if any, address themselves to the problem of maintaining the fixture, or range-hood, in place so as to allow the installer to have all hands free for insertion of the final retaining devices. With most of the contemporary attaching devices the installer must still use his hands, shoulder, or another person, to erect the range-hood to its required position and maintain it there while fumbling with the devices which will eventually maintain the range-hood's position on that wall or soffit.

It has become apparent that of the prior art examined, most attempts to improve installation or attachment devices has been through the modification of how a device sits into or behind a mounting surface. Little if any examination has been made into the area of facilitating the actual installer's effort by the development of a device which offers a preliminary restraint of the range-hood in a juxtaposed position to the mounting surface, allowing such an installer free use of both his hands and shoulders to affix the final mounting attachments towards completion of a finished, secure, and attractive mounting.

The present invention addresses itself to the area of installation for a range-hood assembly. It is the object of the present invention to allow preliminary attachment in a juxtaposed manner to the surface means, whether it be a wall or a soffit, through the use of two snap-in bracketing devices. These bracketing devices are secured by conventional screwing means onto the surface of the wall or soffit and are so spaced apart as to align with receiving slots on the upper rear portion of the range-hood when it is mounted on the wall, and the rear top portion of the range-hood when it is mounted to a soffit so as to suspend down from such a soffit.

The outside edges of the mounting bracket serve also as an identifying locater for where the outside corners of the range-hood will finally be installed. Towards this purpose, it is further an object of the present invention to allow the installer to set up the snap-in mounting brackets on the wall or soffit within the constraints of the dimensions of the range-hood itself, thus requiring the installer to space the outside edges of the snap-in brackets apart from one another to equal the horizontal length of the particular model range-hood he has purchased. Once these brackets have been installed the installer need only align the entire range-hood assembly's slots with the mounted brackets and push this range-hood assembly onto the brackets until both have snapped in place.

At the time when both brackets have snapped into either the top portion or the rear portion of the range-hood to be installed, depending as to whether the hood will be installed on a wall or soffit, the installer is now free to use both his hands and any other parts of his body to locate, start, and finally fasten two final mounting screws which sandwich in the hood assembly between the wall or soffit, and the bottom of the head of these final mounting screws, and which complete the mounting of the range-hood assembly.

It is therefore the over-all object of the present installation device to allow successful, secure, and attractive installation of a manufacturer's range-hood, with little effort and in minutes from the time the range-hood is un-packaged to the time it is ready for functional use over a cooking area.

SUMMARY OF THE INVENTION

The present invention is an installation assembly device for facilitating the positioning and secure restraining of a range-hood assembly which contains the necessary equipment for conducting atmospheric flow. The assembly device is comprised of a bracketing body which is mounted fixedly onto a surface means against and onto which the range-hood assembly will be juxtaposed. The bracketing bodies have the means to meet and mechanically latch onto the range-hood assembly itself when the assembly engages the bracketing body and is pushed onto a portion of the bracket by exerted force, past an initial engagement until the brackets snap into and fixedly behind portions of the range-hood assembly. The snap-in brackets thus restrain the entire hood assembly in a juxtaposed position to the surface means thereby maintaining the hood assembly in a suspended position allowing an installer to continue the final fastening of the device without having to maintain by exerted force, the position and suspension of the range-hood, and without requiring a second installer to hold said range-hood assembly while the first installer is inserting and restraining the final mounting devices. The installation assembly device also comprises a slotted orifice configuration on the range-hood assembly itself so as to enable engagement with and secure fastening by the already mounted snap-in brackets and so as to allow maintenance of the range-hood assembly in a juxtaposed position adjoining the surface means onto which the bracketing bodies are affixed. The placement of the slotted orifice configuration on the range-hood assembly allows for the use of the outer edges of the mounting feet on the bracketing body, as locating identifiers for where the outsides edges of the range-hood assembly will finally rest upon complete installation.

One such embodiment exists in utilizing the bracketing body's snap-in features with slotted orifice configuration applied to the top panel of the range-hood assembly so as to allow installation of the range-hood assembly in a secure and easily mountable manner to the lower surface means of a soffit or overhanging surface area from which the range-hood is desired to suspend downwardly.

A second embodiment of the present invention provides for the equivalent installation of the range-hood assembly to a wall surface means, through the use of the same bracketing body and its capability of snapping-in through the slotted orifice configuration on the rear panel of the range-hood assembly.

In both embodiments the final positioning of the fully installed range-hood assembly, facilitated by the installation assembly device, will be directly over the cooking area of an abode at an elevation of from 12 to 28 inches. This positioning will enable the passage of air, containing cooking vapors and/or smoke, through the bottom enlarged aperture of the range-hood assembly by way of suction, which has been created by a blower assembly hidden out of view within the canopied range-hood assembly.

Thus the positioning of the range-hood will allow the intake of stale or contaminated air with this contaminated air being exhausted either through the side of the building or out the top of the building in which the cooking area is housed. In yet another contemplated embodiment, the stale or contaminated air will be recycled within the hood through a filtering element, purified, and re-discharged into the cooking area as fresh air for further use, this type of range-hood generically known as the ductless variety.

DETAILED DESCRIPTION

Figure 3:
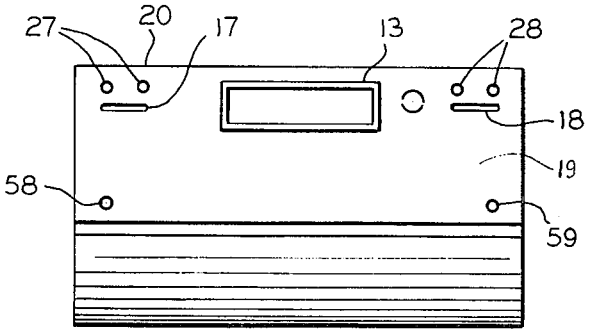
FIG. 3 is a top view taken along the lines 3—3 and looking in the direction of the arrows.

While this invention is susceptible of embodiment in many different forms, there is shown in the drawings and will herein be described in detail, two specific embodiments, with the understanding that the present disclosure is to be considered as an exemplification of the principles of the invention and is not intended to limit the invention to the embodiments illustrated.

Figure 1:
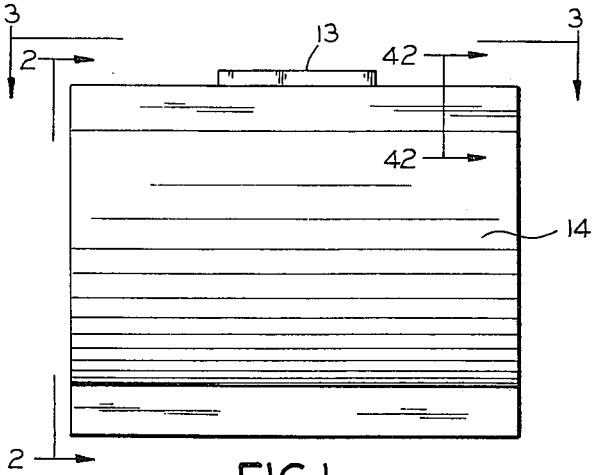
FIG. 1 is a front elevational view of the present invention in the first embodiment in which the exhausting means protrude out of the top panel of the range-hood assembly.
Figure 2:
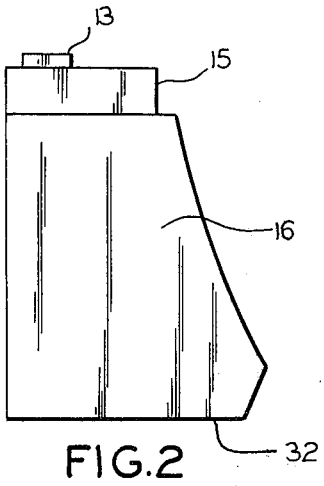
FIG. 2 is a side view taken along lines 2—2 and looking in the direction of the arrows.

The first embodiment of the device is shown in FIG. 1 of the drawings. The entire front panel 14 can be seen as well as the protruding ductwork 13 emanating from the back of the top panel of the range-hood assembly. In the installation of the range-hood assembly the protruding ductwork 13 adjoins the continuing ductwork protruding from the soffit which is already provided in the abode. A side view of the range-hood assembly is shown in FIG. 2 with side panel 16 shown in full view as well as decorative flange 15 which was incorporated onto the front panel of the range-hood assembly for decorative and strength reinforcing purposes. A side view of protruding ductwork 13 can also be seen in FIG. 2 emanating from the top panel of the range-hood assembly, as well as the edge of bottom chamber aperture 32. A top view of the first embodiment is shown in FIG. 3 with top panel 19 having elongated slotted orifices 17 and 18, circular hole sets 27 and 28 which allow the protrusion of the screwing device heads so as to enable flush mounting against the soffit and also allow access to the screwheads holding the bracketing bodys so as to remove the range-hood assembly and bracketing bodys should it be desired, and final mounting orifices 58 and 59. The entire description of protruding ductwork 13 is similarly shown in this figure as it emanates from the top panel of the range-hood assembly, as well as the outline of adjoining rear panel 20.

Figure 4:
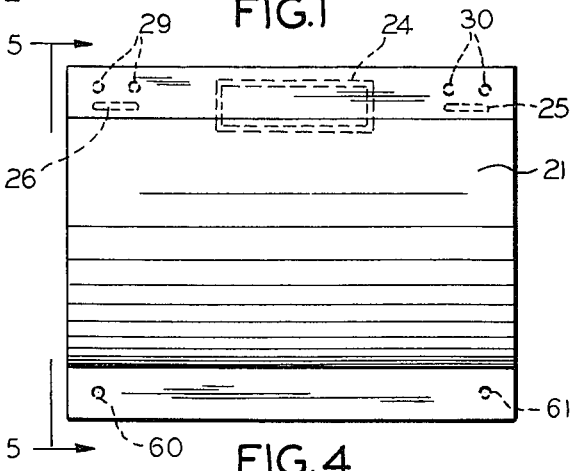
FIG. 4 is a front elevational view of the second embodiment of the invention in which the exhausting means protrude out of the rear panel of the range-hood assembly.
Figure 5:
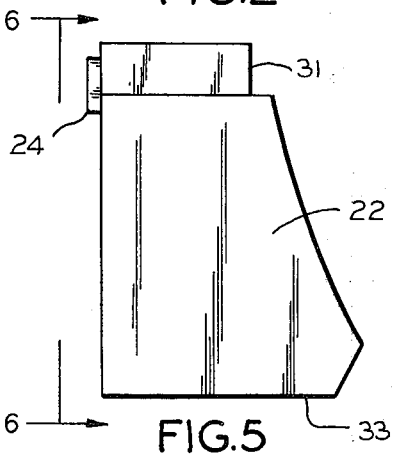
FIG. 5 is a side view taken along lines 5—5 and looking in the direction of the arrows.
Figure 6:
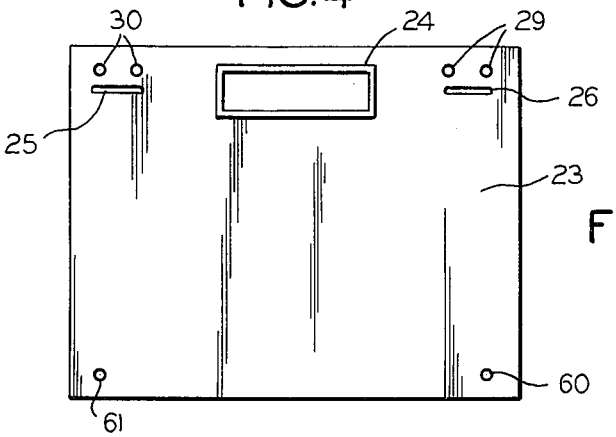
FIG. 6 is a rear view of the range-hood assembly taken along lines 6—6 and looking in the direction of the arrows.

The second embodiment of the present invention is shown in the views provided by FIGS. 4, 5, and 6. The front view of the second embodiment in FIG. 4 shows front panel 21, and in phantom on the rear panel, are shown elongated slotted orifices 26 and 25, hole sets 29 and 30 through which the heads of the bolting devices for the bracketing body protrude, protruding ductwork 24 which is attached to and protrudes outwardly from the rear panel of the range-hood assembly, and final mounting orifices 60 and 61. A side view of the second embodiment is shown in FIG. 5 displaying side panel 22, decorative flange 31 which is a part of the front panel, protruding ductwork 24 and the outline of the edge of the bottom chamber aperture 33 through which contaminated air containing smoke and/or cooking vapor is drawn. The rear panel of the wall mountable range-hood assembly shown in FIG. 6 displays rear panel 23, slotted orifices 25 and 26 through which the bracketing bodies will snap, hole sets 30 and 29 through which the heads of the fastening devices shall protrude, protruding ductwork 24 through which contaminated air shall be exhausted to the adjoining ductwork facilities provided in the abode for exhaustion out the side of the building in which the cooking facilities are located, and final mounting orifices 61 and 60.

Figure 7:
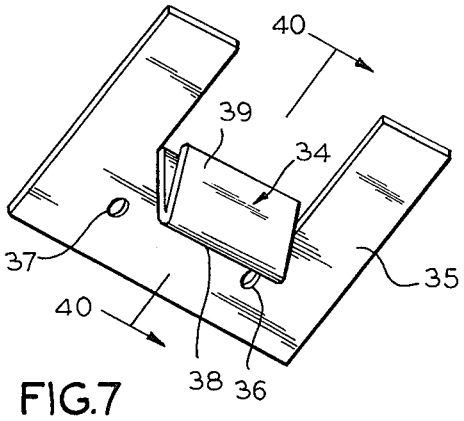
FIG. 7 is a bottom perspective view of the bracketing body onto which the range-hood assembly is snapped during installation.

A detailed perspective view of the bracketing body device itself is shown in FIG. 7. The bracketing body will be mounted securely onto the surface to which the range-hood assembly will eventually be juxtaposed. The U-shaped mounting portion 35 of the bracketing body is juxtaposed to the surface means and is fastened by screws inserted through fabricated orifices 36 and 37. The protruding portion 34 of the bracketing body is V-shaped making a point at 38 and with one side 39 shorter than the other side which connects to the bracketing body's mounting portion. As protruding portion point 38 is pushed through the slotted orifices on the range-hood assembly, the V-shape constricts, and as soon as the orifice passes shorter side 39, the V-shaped portion 34 retains its original uncontorted shape as side 39 snaps behind and thus under a portion of the range-hood assembly. Thus, the bracketing body has latched onto the range-hood assembly enabling it and any other bracketing bodies to maintain the assembly in a juxtaposed position along side a wall or under a soffit.

Figure 8:
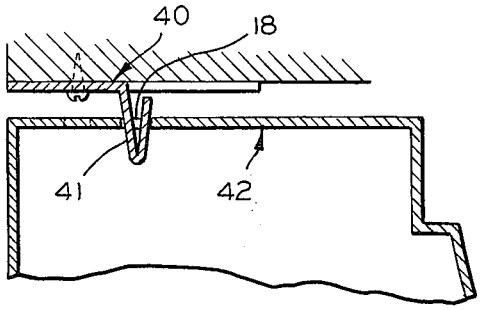
FIG. 8 is an elevational cross-sectional view of the range-hood assembly engaging with the bracketing body before the bracketing body snaps into and behind a portion of the range-hood assembly.
Figure 9:
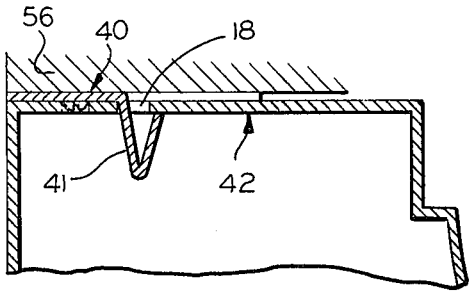
FIG. 9 is a elevational cross-section view showing the juxtaposed position of the range-hood assembly after the bracketing body has snapped into and behind a portion of the range-hood assembly.

A cross-sectional view of the bracketing body 40 which was taken along lines 40—40 and in the direction of the arrows from FIG. 7, is shown in FIG. 8 in the intermediary process whereby the bracketing body's protruding portion 41 is sliding through the slotted orifice 18 of range-hood assembly 42, cross-section 42 being taken along the lines 42—42 and in the direction of the arrows from FIG. 1. The completed snapped-in assembly is shown in FIG. 9 in which the protruding portion 41 of the bracketing body extending through slotted orifice 18 now restrains range-hood assembly 42 by having snapped-in and behind the range-hood assembly. Mounting foot portion 40 of the bracketing body is thus restraining the bracketing body and the snapped-in range-hood assembly in a juxtaposed position to the surfacing means 56.

Figure 10:
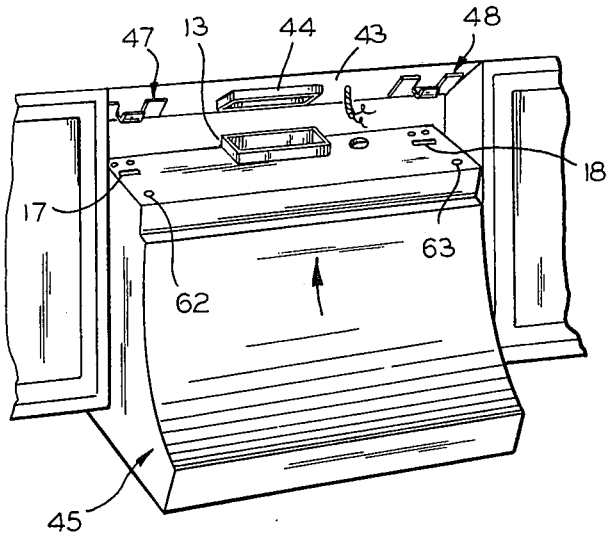
FIG. 10 is a perspective view showing the installation of the range-hood assembly in the first embodiment where it is installed juxtaposed to the bottom of a soffit by the top panel of the range-hood assembly.

A perspective view diagramming the installation and positioning of the first embodiment of the invention is shown in FIG. 10. When finally installed, bracketing bodies 47 and 48 will have snapped in and through slotted orifices 17 and 18 respectively, thus restraining range-hood assembly 45 in position and juxtaposed to soffit 43. Protruding ductwork 13 from the top panel of the range-hood assembly meets and adjoins continuing ductwork 44 which already exists in the abode, and provides for the exhaustion of the contaminated air up to and out through a roof portal into the outer atmosphere. Fastening devices will be mounted through final mounting orifices 62 and 63 while hood is restrained juxtaposed to the soffit to finish installation.

Figure 11:
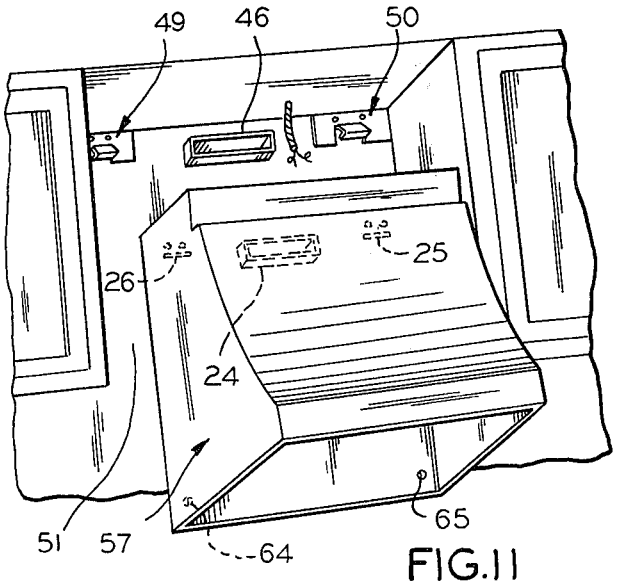
FIG. 11 is a perspective view showing the installation of the range-hood assembly in the second embodiment where it is installed juxtaposed to the side of a wall by the rear panel of the range-hood assembly.

The second embodiment, displaying attachment of the hood assembly via the installation device to a wall, is shown in FIG. 11. When completely installed, bracketing bodies 49 and 50 will have engaged and snapped into and behind slotted orifices 26 and 25 thus securing range-hood assembly 57 in a juxtaposed position alongside wall surface 51. As in the previous embodiment rear panel protruding ductwork 24 will adjoin the abode ductwork 46 for exhaustion of contaminated air through the range-hood, out its rear, and finally out a side portal of the building in which the cooking area is located. Fastening devices will be mounted through final mounting orifices 64 and 65 while hood is restrained juxtaposed to the wall so as to finish installation.

Figure 12:
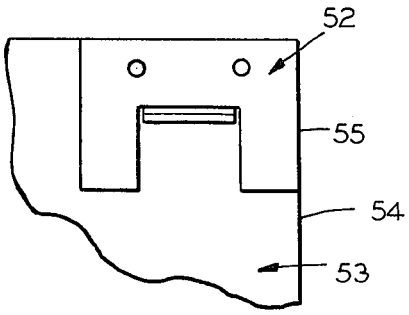
FIG. 12 is a side elevational view of a bracketing body snapped into the corner of the range-hood assembly showing the alignment of the outer perimeter of the bracketing body with the outer perimeter of the range-hood assembly.

The use of the bracketing body and corresponding slotted orifices as a guide for locating the edges of the actual range-hood assembly is shown in FIG. 12. When fully installed, the outside edge 55 of the bracketing body 52 will be fabricated so as to align exactly with the outside edge 54 of range-hood assembly 53. This thus provides for the installer a preliminary means of identifying the positioning of the range-hood by serving to locate for the installer the outer edges of his range-hood assembly.

The foregoing description and drawings merely explain and illustrate the invention and the invention is not limited thereto, except in so far as the appended claims are so limited, as those skilled in the art who have the disclosure before them will be able to make modifications and variations therein without departing from the scope of the invention.

What is claimed is:

1. An installation mounting device facilitating the positioning and secure restraining of a suspended fixture assembly, said device comprising:

a. bracketing body means mounted onto a surface means against which said suspended fixture assembly will be juxtaposed, said bracketing body means including latching means to mechanically latch to said suspended fixture assembly, said bracketing body means comprising means for fixedly mounting said bracketing body means to said surface means so as to enable firm engagement of said bracketing body means juxtaposed to said surface means; and latching means including protruding portion means which insert through and automatically snap behind slotted orifice means to fixedly suspend said fixture means, and b. said slotted orifice means on said suspended fixture assembly receiving said latching means to attach and maintain said suspended fixture assembly juxtaposed to the surface means onto which said bracketing body means is affixed.

2. The invention according to claim 1, in which said suspended fixture assembly comprises a metallic range-hood assembly.

3. An installation mounting device facilitating the positioning and restraining of a suspended fixture assembly, said device comprising:

bracketing body means mounted onto a surface means against which said suspended fixture assembly will be juxtaposed, said bracketing body means including latching means to mechanically latch to said suspended fixture assembly, said bracketing body means comprising means for fixedly mounting said bracketing body means to said surface means so as to enable firm engagement of said bracketing body means juxtaposed to said surface means; and latching means including protruding portion means which can be inserted through and snapped behind said slotted orifice means, said means for fixedly mounting said bracketing body means to said surface means comprising a planar substantially U-shaped mounting portion, at least one orifice means in said mounting portion, and fastening means holding said bracketing body juxtaposed to said surface means when placed through said orifice means, and driven into and behind said surface means; and slotted orifice means on said suspended fixture assembly for receiving said latching means to attach and maintain said suspended fixture assembly juxtaposed to the surface means onto which said bracketing body means is affixed, said slotted orifice means arranged to use the outer periphery of said bracketing body means to position the outer perimeter of said suspended fixture assembly.

4. The invention according to claim 3, in which the protruding portion means comprises a V-shaped portion extending outwardly from said mounting portion, said V-shaped portion having one side substantially perpendicular to said mounting portion, said V-shaped portion being resilient whereby its ends are capable of being forced together as the point of the V is inserted through said slotted orifice means and said other side of the V-shape portion being shorter than the one side to which the mounting portion of the bracketing body means is attached, thereby enabling said shorter side of said V-shape protrusion to resiliently snap back to its original uncontorted shape once the slotted orifice means has been penetrated past said shorter side's length.

5. An installation mounting device facilitating the positioning and secure restraining of a suspended fixture assembly, said device comprising:

bracketing body means mounted onto a surface means against which said suspended fixture assembly will be juxtaposed, said bracketing body means including latching means to mechanically latch to said suspended fixture assembly; and slotted orifice means on said suspended fixture assembly for receiving said latching means to attach and maintain said suspended fixture assembly juxtaposed to the surface means onto which said bracketing body means is affixed, said slotted orifice means arranged to use the outer periphery of said bracketing body means to position the outer perimeter of said suspended fixture assembly, said slotted orifice means on said suspended fixture assembly comprising:

a. a pair of narrow elongated slots on a top panel and toward the back of said top panel and a pair of narrow elongated slots on a rear panel and towards the top of said rear panel thereby enabling a given fixture assembly to be installed by the top panel against a soffit, and by the rear panel against a wall; and said elongated slots enabling insertion of the latching means of said bracketing body means;

b. holes for receiving protruding portions of the fasteners affixing the bracketing body means to the surface means, thereby enabling a flush mounting of said assembly with said surface means while enabling later removal of said fixture assembly and said bracketing body should it be desired;

c. said slotted orifice means comprising at least a pair of spaced apart aligned slotted orifices; and d. means for utilizing the outer periphery of said bracketing bodies as guides for positioning said fixture assembly onto said surface means, comprising said pair of slotted orifice means spaced apart so as to enable insertion of said latching means when the outside edges of the bracketing body are aligned with the outside perimeter of said suspended fixture when mounted juxtaposed to said surface means, thereby affording use of said bracketing body means as guides for the desired placement of the outer edges of said fixture assembly.

6. A method for installing and restraining a suspended fixture assembly to a surface means wherein bracketing body means support and suspend the fixture assembly, said bracketing body means having a V-shaped resilient protruding portion for insertion into slotted orifice means in said fixture assembly, said V-shaped protruding portion automatically snapping behind said fixture after insertion into and through the slotted orifice means to fixedly suspend the fixture assembly, comprising the steps of:

a. fixedly mounting at least one of said bracketing body means onto surface means against and onto which said suspended fixture assembly will be juxtaposed;

b. positioning said suspended fixture assembly towards engagement with said bracketing body;

c. pushing said fixture assembly past an initial engagement with said bracketing body so as to cause said assembly to travel along the protruding portion means of said bracketing body until said protruding portion means snaps into and fixedly behind slotted orifice means on said suspended fixture assembly;

d. releasing the securely restrained fixture assembly in a juxtaposed position to said surface means; and e. affixing final attachment devices through final mounting orifices, to complete installation, thereby avoiding the necessity of manually holding said assembly in juxtaposition while simultaneously inserting final attachment devices as conventionally performed.

* * * * *